US012247345B2

(12) United States Patent
Lee et al.

(10) Patent No.: US 12,247,345 B2
(45) Date of Patent: Mar. 11, 2025

(54) LAUNDRY TREATMENT APPARATUS AND METHOD FOR OPERATING THE SAME

(71) Applicant: LG Electronics Inc., Seoul (KR)

(72) Inventors: Kwangjo Lee, Seoul (KR); Gayeong Jeong, Seoul (KR); Hyojin Joo, Seoul (KR); Jangan Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 955 days.

(21) Appl. No.: 17/217,614

(22) Filed: Mar. 30, 2021

(65) Prior Publication Data

US 2021/0301456 A1 Sep. 30, 2021

(30) Foreign Application Priority Data

Mar. 30, 2020 (KR) ..... 10-2020-0037968

(51) Int. Cl.

| | |
|---|---|
| ***D06F 58/24*** | (2006.01) |
| ***D06F 25/00*** | (2006.01) |
| ***D06F 33/69*** | (2020.01) |
| ***D06F 39/06*** | (2006.01) |
| ***D06F 39/20*** | (2024.01) |
| ***D06F 58/04*** | (2006.01) |
| ***D06F 58/20*** | (2006.01) |
| ***D06F 58/30*** | (2020.01) |

(Continued)

(52) U.S. Cl.

CPC ..... *D06F 58/24* (2013.01); *D06F 25/00* (2013.01); *D06F 33/69* (2020.02); *D06F 39/06* (2013.01); *D06F 39/20* (2024.01); *D06F 58/04* (2013.01); *D06F 58/203* (2013.01); *D06F 58/30* (2020.02); *D06F 58/38* (2020.02); *D06F 58/206* (2013.01); *D06F 2103/08* (2020.02)

(58) Field of Classification Search

CPC ..... D06F 25/00; D06F 33/69; D06F 39/006; D06F 39/06; D06F 39/20; D06F 58/04; D06F 58/30; D06F 58/38; D06F 58/203; D06F 58/206

See application file for complete search history.

(56) References Cited

U.S. PATENT DOCUMENTS

2012/0159972 A1* 6/2012 Haryanto ..... F24F 13/1406 62/132

FOREIGN PATENT DOCUMENTS

| | | | |
|---|---|---|---|
| CN | 206956390 | | 2/2018 |
| CN | 108866915 A | * | 11/2018 |
| CN | 109402948 A | * | 3/2019 |

(Continued)

OTHER PUBLICATIONS

Electronic translation of CN 108866915 A to Zhao. (Year: 2018).*

(Continued)

*Primary Examiner* — Joseph L. Perrin
(74) *Attorney, Agent, or Firm* — Fish & Richardson P.C.

(57) ABSTRACT

A laundry treatment apparatus includes a cabinet, a condensed water collector that is disposed in the cabinet and defines a collection space configured to receive condensed water therein, a discharge pump assembly disposed at the condensed water collector and configured to pump the condensed water from the condensed water collector, a water discharge container configured to receive the condensed water collector pumped from the condensed water collector, and a sterilization module configured to sterilize the condensed water in the condensed water collector.

20 Claims, 17 Drawing Sheets

(51) Int. Cl.
*D06F 58/38* (2020.01)
*D06F 103/08* (2020.01)

(56) References Cited

FOREIGN PATENT DOCUMENTS

| | | | | |
|---|---|---|---|---|
| CN | 210002140 | | 1/2020 | |
| KR | 10-2010-0090087 | | 8/2010 | |
| KR | 10-2013-0127816 | | 11/2013 | |
| KR | 10-2016-0087183 | | 7/2016 | |
| KR | 10-2016-0149852 | | 12/2016 | |
| WO | WO-2016150648 | A1 * | 9/2016 | ..... D06F 33/02 |

OTHER PUBLICATIONS

Electronic translation of CN 109402948 A to Hu et al. (Year: 2019).*
Electronic translation of CN 210002140 U to Chi et al. (Year: 2020).*
Extended European Search Report in European Appln. No. 21165209.4, dated Aug. 12, 2021, 10 pages.

* cited by examiner

LAUNDRY TREATMENT APPARATUS AND METHOD FOR OPERATING THE SAME

CROSS-REFERENCE TO RELATED APPLICATIONS

This application claims the benefit of Korean Patent Application No. 10-2020-0037968, filed on Mar. 30, 2020, which is hereby incorporated by reference as when fully set forth herein.

TECHNICAL FIELD

The present disclosure relates to a laundry treatment apparatus having a structure with improved sterilization performance to prevent or reduce contamination of residual water, and a method for operating the laundry treatment apparatus.

BACKGROUND

A laundry treatment apparatus may include a washing machine, a laundry dryer, a laundry washing and drying apparatus, a clothing manager, etc. The laundry treatment apparatus may be disposed in a home and a laundry shop, and perform a function for all or some of treatments such as washing, drying, or removing wrinkles for laundry or various bedding.

In some cases, the laundry treatment apparatuses may include a laundry dryer that has a heat pump system and is configured to supply hot-air to a treatment target such as the laundry or bedding in a tub or a drum. The heat pump system may operate to evaporate moisture contained in the treatment target to dry the treatment target.

In some cases, the laundry dryer may be classified into a discharge-type dryer and a condensation-type dryer according to a treatment scheme of hot and humid air that exits the drum after drying the treatment target.

For example, the discharge-type dryer may directly discharge the high-temperature and humid air produced during the drying operation to an outside. The condensation-type dryer may condense moisture contained in the air through heat exchange while circulating the hot and humid air produced during the drying operation without discharging the air to the outside.

In some cases, the condensation-type dryer may include a heat pump system including a compressor, a condenser, an expander, and an evaporator. The moisture may be removed from the air while the air is passing through the evaporator of the heat pump system, and then the air may be heated while the air is passing through the condenser.

In some cases, the condensation-type dryer may produce a large amount of condensed water via heat-exchanging while air passes through the evaporator.

In some cases, the condensed water may not be completely discharged from the area where the water pump due to a structural limitation of the water pump.

For example, a certain amount of condensed water may always remain in a condensed water collector, which may lead to contamination due to the residual water.

In some cases, the condensed water collector may be blocked from an external environment so that the condensed water can be pumped therein easily. The residual water in an inner space of the collector may not evaporate rapidly and remain in the collector for a long time, which may cause propagation of bacteria due to contamination of the residual water.

In some cases, high temperature heat may be supplied to kill the bacteria contained in the condensed water. In some cases, the bacteria may be killed by chemicals. However, the high temperature heat may use consume a large amount of energy, and the chemicals may remain in the laundry.

SUMMARY

The present disclosure describes a laundry treatment apparatus having a sterilization function that enables sterilization of the condensed water stored in the condensed water collector to prevent or reduce contamination of the condensed water, and provides a method for operating the same.

The present disclosure further describes a laundry treatment apparatus that has a sterilization function to allow condensed water to be sterilized in a process of introducing the condensed water into the condensed water collector to thereby prevent or reduce condensed water contamination in the condensed water collector, and provides a method for operating the apparatus.

The present disclosure further describes a laundry treatment apparatus that has a sterilization function capable of inhibiting bacterial growth in the condensed water remaining in the condensed water collector, and provides a method for operating the apparatus.

According to one aspect of the subject matter described in this application, a laundry treatment apparatus includes a cabinet, a condensed water collector that is disposed in the cabinet and defines a collection space configured to receive condensed water therein, a discharge pump assembly disposed at the condensed water collector and configured to pump the condensed water from the condensed water collector, a water discharge container configured to receive the condensed water collector pumped from the condensed water collector, and a sterilization module configured to sterilize the condensed water in the condensed water collector.

Implementations according to this aspect can include one or more of the following features. For example, the discharge pump assembly can include a water pump, and a pump cover that covers the condensed water collector, where the sterilization module is disposed at the pump cover. In some examples, the pump cover can define a light-transmitting hole through the pump cover, where the sterilization module is configured to provide light to the condensed water in the condensed water collector through the light-transmitting hole. In some examples, the light-transmitting hole passes through a top surface of the pump cover, and the sterilization module is disposed on an outer side of the top surface of the pump cover. In some examples, the light-transmitting hole is defined at a position of the top surface of the pump cover to thereby face the condensed water flowing into the condensed water collector.

In some implementations, the sterilization module can include a circuit board and a light emitting diode (LED) mounted on the circuit board, the LED being configured to emit ultraviolet light. In some implementations, the sterilization module can include a casing that defines an installation space accommodating the circuit board, and an irradiation hole at a bottom surface of the casing, where the irradiation hole is in communication with the light-transmitting hole. The sterilization module can further include a transmissive window that is disposed at the bottom surface of the casing and covers the irradiation hole, and a sealing that couples the transmissive window to the casing. In some examples, the casing can be fastened to the top surface of the pump cover by a screw or a bolt.

In some examples, a bottom surface of the sealing can cover a portion of the top surface of the pump cover and surrounds the light-transmitting hole, the sealing being configured to block introduction of the condensed water through the light-transmitting hole. In some examples, the bottom surface of the sealing defines a communication-hole that is in communication with the irradiation hole and the light-transmitting hole. In some examples, the bottom surface of the sealing can define a recess that surrounds the communication-hole and receives the transmissive window. In some examples, a recess depth of the recess can be greater than a thickness of the transmissive window.

In some implementations, the sealing can have a circular ring shape and define a communication-hole at a center of the sealing. In some examples, a bottom surface of the sealing defines at least one of a circular concave pattern or a circular convex pattern that surrounds the communication-hole.

In some implementations, the laundry treatment apparatus can include a collection pipe disposed at the top surface of the pump cover and configured to collect water overflown from the water discharge container, where the light-transmitting hole is located adjacent to the collection pipe.

According to another aspect, a laundry treatment apparatus includes a heat pump configured to heat air for drying laundry and to condense moisture from the air that is used for drying the laundry, a circulation fan configured to circulate the air, a condensed water collector configured to receive condensed water from the heat pump, a discharge pump configured to pump the condensed water from the condensed water collector, a sterilization module configured to irradiate ultraviolet light to the condensed water in the condensed water collector, and a controller configured to control the heat pump, the circulation fan, the discharge pump, and the sterilization module. The controller is configured to activate the heat pump and the circulation fan for drying the laundry, activate the discharge pump and the sterilization module to thereby irradiate the ultraviolet light to the condensed water while operating the discharge pump, and deactivate the heat pump and the circulation fan.

Implementations according to this aspect can include one or more of the following features. For example, the controller can be configured to activate the sterilization module to irradiate the ultraviolet light before deactivating the heat pump and the circulation fan. In some examples, the controller can be configured to alternately activate and deactivate the discharge pump. In some examples, the controller can be configured to set an activation duration for operating the discharge pump and a deactivation duration for stopping operation of the discharge pump, where the activation duration is less than the deactivation duration.

DETAILED DESCRIPTIONS

Hereinafter, one or more implementations of a laundry treatment apparatus and a method for operating the same will be illustrated with reference to the accompanying FIGS. 1 to 20.

In some implementations, the laundry treatment apparatus can be or include a laundry dryer that supplies dry hot-air to dry laundry.

Figure 1:
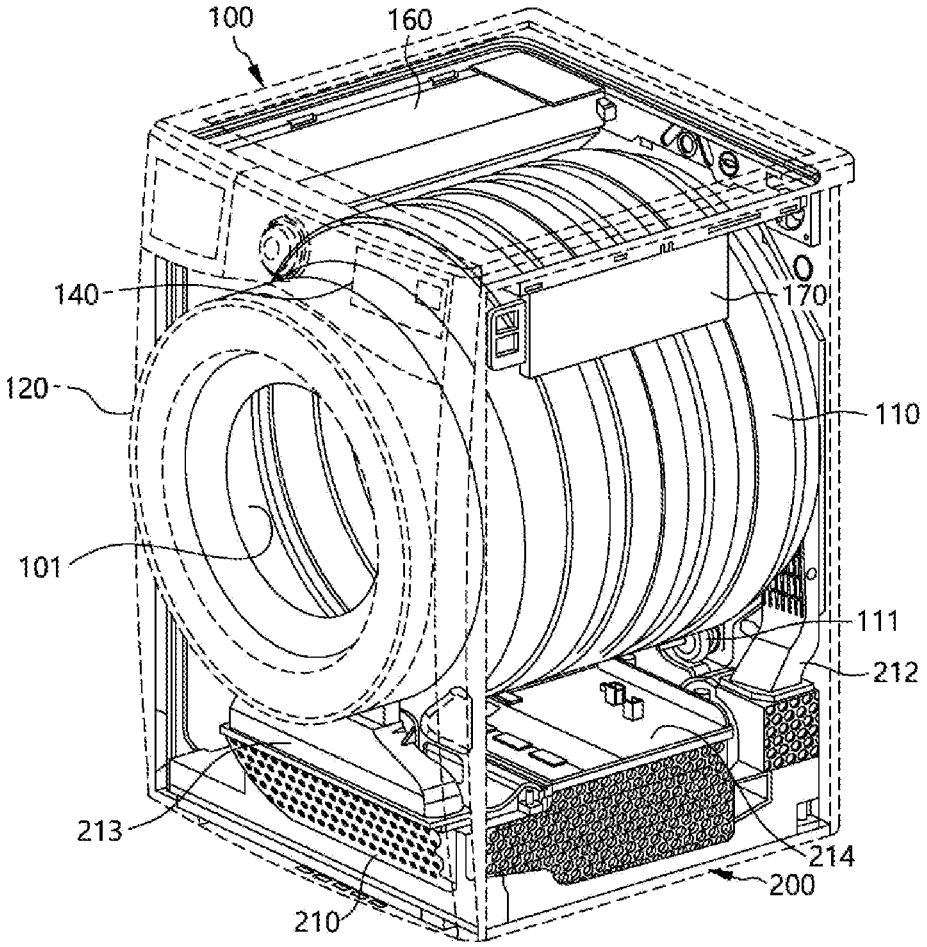
FIG. 1 is a perspective view showing an internal structure of an example of a laundry treatment apparatus.
Figure 2:
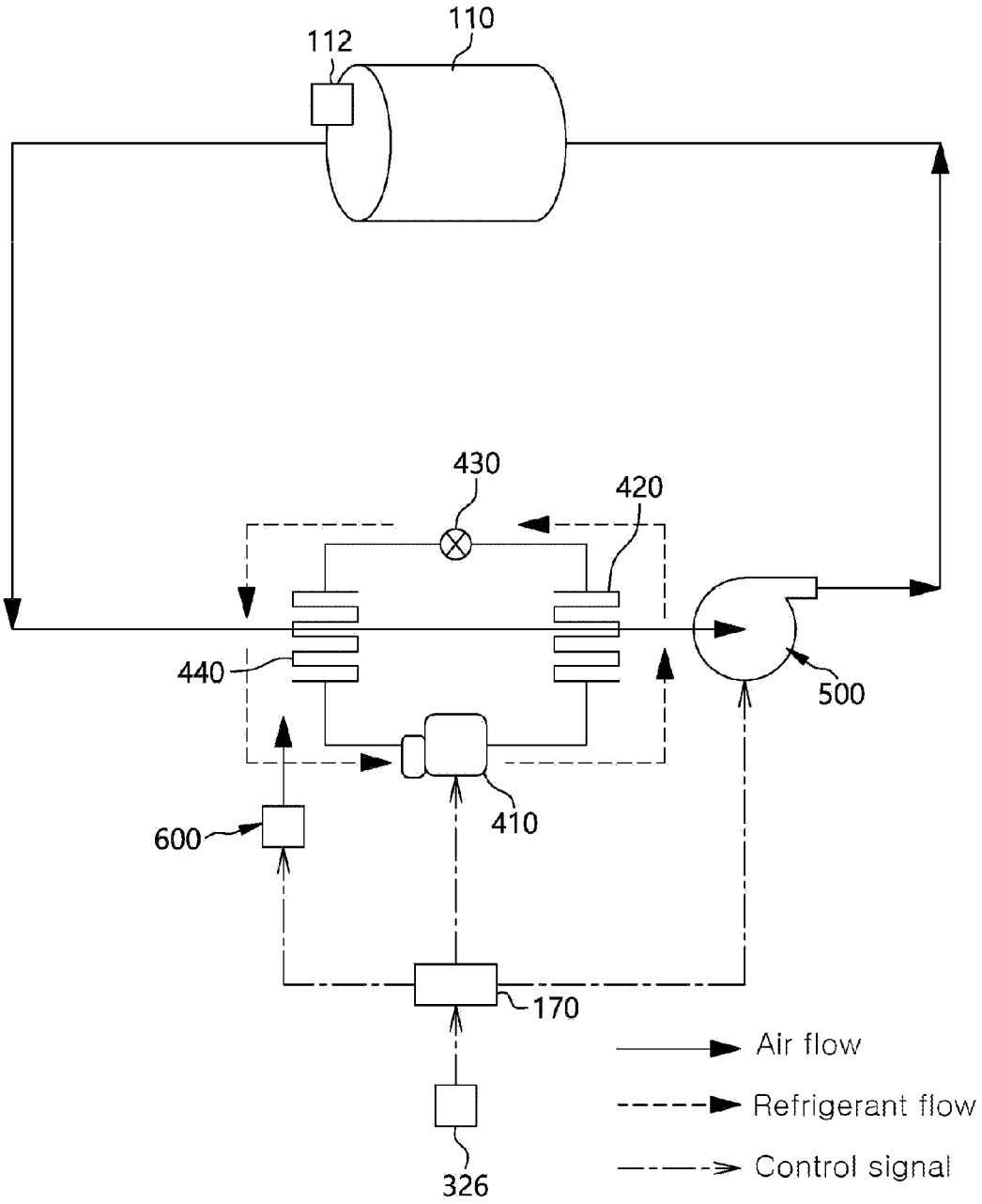
FIG. 2 is a block diagram schematically showing an example of a flow structure for a drying operation and a washing operation by the laundry treatment apparatus.
Figure 3:
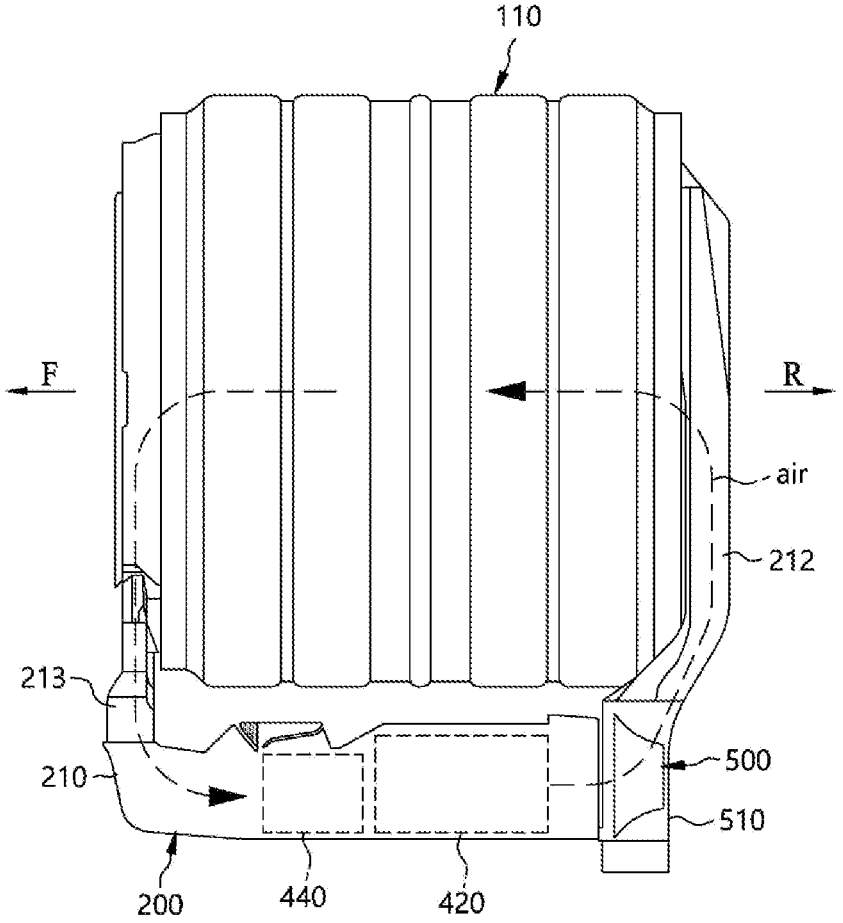
FIG. 3 is a side view schematically showing an example structure for a drying operation by the laundry treatment apparatus.

FIGS. 1 to 7 show an installation structure of example components of the laundry treatment apparatus. Specifically, FIG. 1 is a perspective view showing an example of an internal structure of the laundry treatment apparatus. FIG. 2 is a block diagram schematically showing an example structure for a drying operation and a washing operation by the laundry treatment apparatus. FIG. 3 is a side view schematically showing an example structure for a drying operation by the laundry treatment apparatus.

Figure 4:
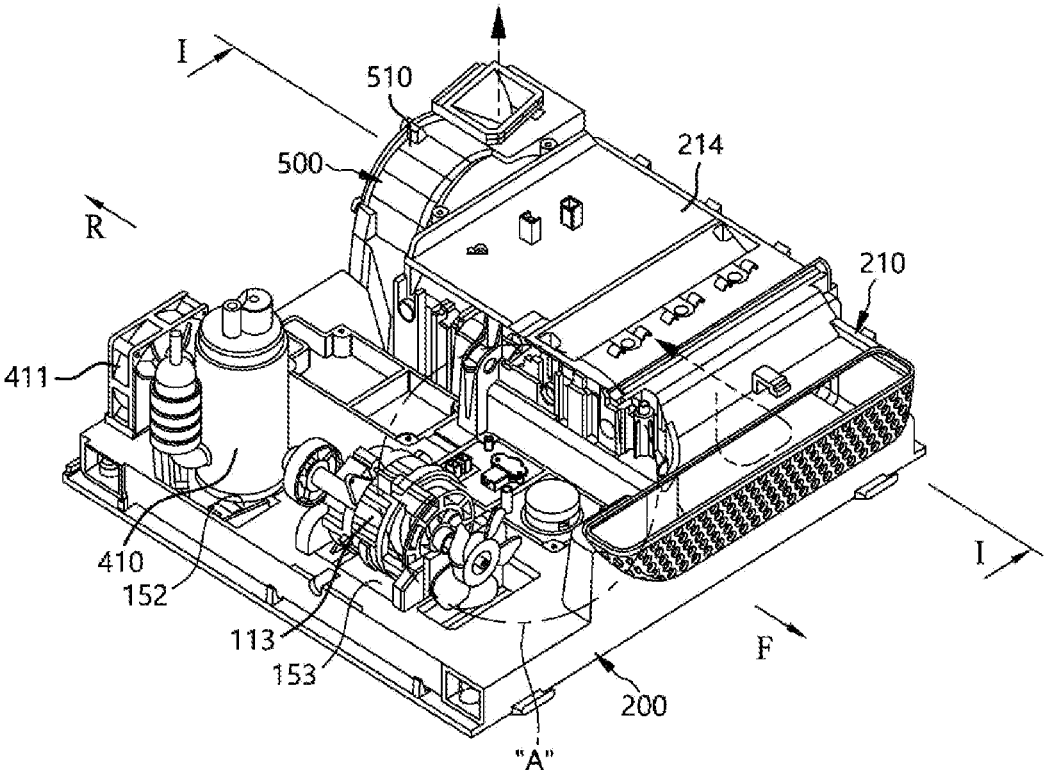
FIG. 4 is a perspective view showing an example of a heat pump system of the laundry treatment apparatus.
Figure 5:
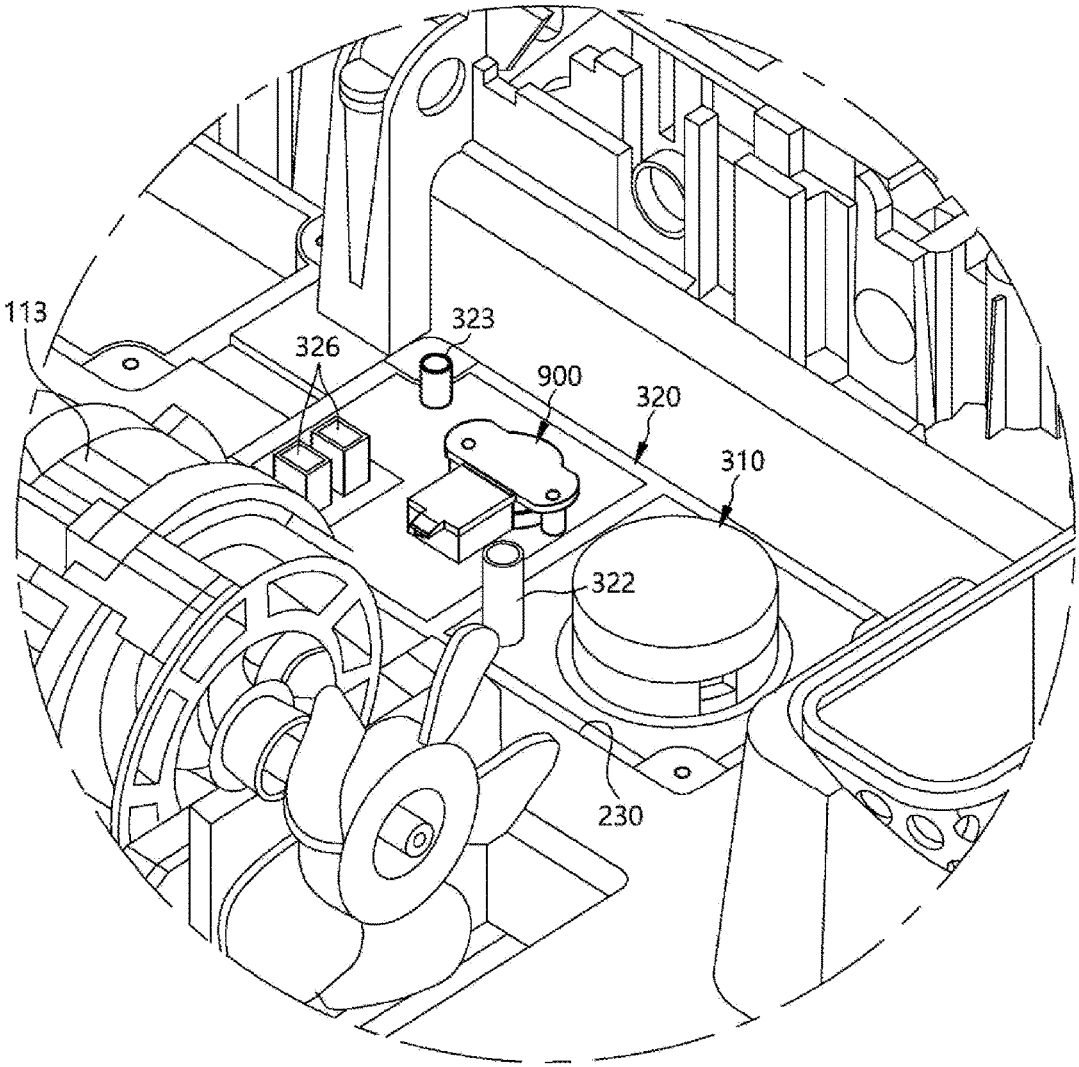
FIG. 5 is an enlarged view of a portion "A" in FIG. 4
Figure 6:
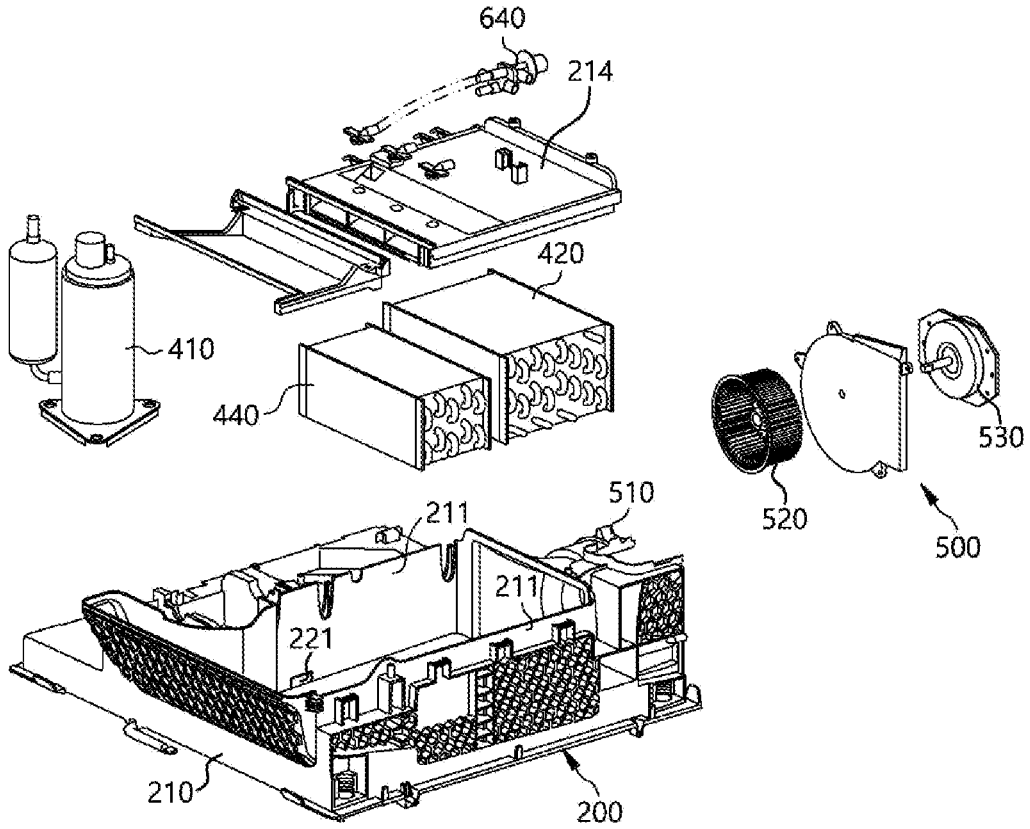
FIG. 6 is an exploded perspective view showing the heat pump system of the laundry treatment apparatus.
Figure 7:
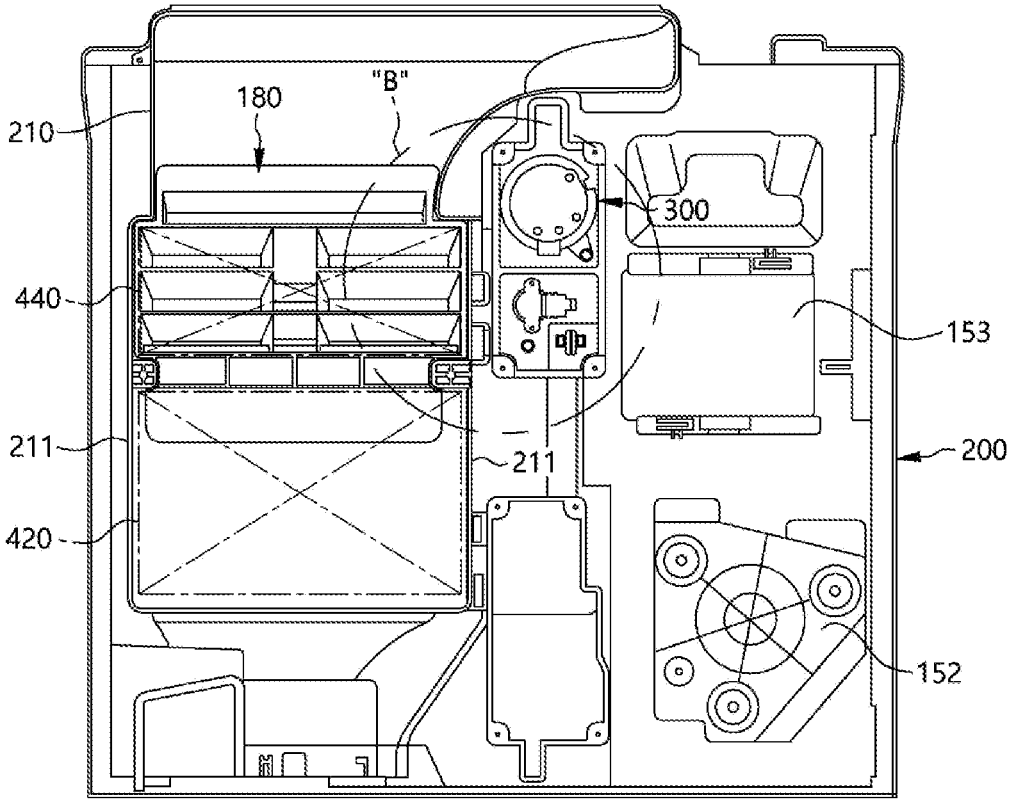
FIG. 7 is a plan view showing an example of a base frame of the laundry treatment apparatus.

Further, FIG. 4 is a perspective view showing an example of a heat pump system of the laundry treatment apparatus. FIG. 6 is an exploded perspective view showing the heat pump system of the laundry treatment apparatus. FIG. 7 is a plan view showing an example of a base frame of the laundry treatment apparatus.

As shown in these drawings, the laundry treatment apparatus can include a sterilization module 900 configured to sterilize the condensed water in a condensed water collector 230.

For example, the condensed water flowing into the condensed water collector 230 can be sterilized via additional provision of the sterilization module 900, so that contamination of the condensed water can be prevented even when the condensed water remains in the condensed water collector 230.

The laundry treatment apparatus having the above feature is largely composed of a cabinet 100, a discharge pump assembly 300, a heat pump system, a circulation fan assembly 500, and the sterilization module 900. A structure of each of the components of the laundry treatment apparatus will be illustrated in more detail with reference to the drawings.

In some implementations, the cabinet 100 is illustrated with referring to FIG. 1.

The cabinet 100 defines an appearance of the laundry treatment apparatus.

The cabinet 100 can be implemented as a hollow body. Inside the cabinet 100, a drum 110 which receives a drying target, that is, laundry can be rotatably installed.

In some examples, a front face of the cabinet 100 has a drying target inlet 101 through which the drying target is input into the drum 110. The drying target inlet 101 can be opened and closed by a door 120.

Further, a water discharge container 160 can be disposed in the cabinet 100. The water discharge container 160 temporarily stores therein condensed water to be drained.

Further, the base frame 200 is disposed on a bottom of the cabinet 100. The base frame 200 can form a floor within the cabinet 100.

In some examples, a separate bottom plate can be disposed to close an open bottom face of the cabinet 100. The base frame 200 can be mounted on the bottom plate and fixed thereto.

The discharge pump assembly 300, the heat pump system, the circulation fan assembly 500, and the circulation channel 210 which will be described later can be installed or formed on a top face of the base frame 200 (a bottom face of the cabinet) as shown in FIGS. 4 to 7.

Referring to FIGS. 4 and 7, a plurality of recesses can be defined in the top face of the base frame 200. The recesses can include a recess 152 for receiving a compressor 410, a recess 153 for receiving a drum driving motor 113, and a recess for receiving the discharge pump assembly 300.

For example, the recesses for receiving the discharge pump assembly 300 can act as the condensed water collector 230 for storage of condensed water.

In some examples, the condensed water stored in the condensed water collector 230 can include condensed water that is condensed via heat exchange between the water produced during the drying operation and an evaporator.

In some examples, the circulation channel 210 can be formed on one side of the face top of the base frame 200.

The circulation channel 210 is configured such that the evaporator 440 and the condenser 420 of the heat pump system are sequentially installed therein. In addition, the circulation channel 210 can be formed in a duct-like structure (see FIG. 6) having left and right walls 211 that guide air flow so that the air passes through the evaporator 440 and the condenser 420 in sequence. In some examples, a top face of the circulation channel 210 can be formed to be open, while a bottom face of the circulation channel 210 can define the top face of the base frame 200.

In some implementations, a shape of the circulation channel 210 can be formed in various structures such as a cylindrical duct as well as a box-shaped duct having an open top face in consideration of a shape of a surrounding structure or air flow characteristics.

In some examples, an inlet duct 212 that guides supplying dry air into the drum 110 can be connected to an air outflow side as a rear side of the circulation channel 210. An outlet duct 213 that guides discharge flow of air discharged from the drum 110 can be connected to an air inlet side as a front side of the circulation channel 210, as shown in FIG. 1.

In addition, the open top face of the circulation channel 210 can be closed by a base cover 214 (see FIGS. 4 and 6). That is, the circulation channel 210 can have an inner space blocked from the external environment with the base cover 214 as described above.

Further, a cover seated groove 220 is defined in the bottom face in the circulation channel 210. In the cover seated groove 220, a water cover 180 on which the evaporator 440 and the condenser 420 are fixedly mounted can be seated. In some examples, a side wall (a rear side wall) of the cover seated groove 220 can have a through-hole 221 (see FIG. 6, FIG. 10, and FIG. 12) defined therein that communicates with a front space of the condensed water collector 230.

For example, the condensed water dropped to a floor in the circulation channel 210 flows down into the cover seated groove 220 and then flows backward along a bottom face of the cover seated groove 220, and then passes through the through-hole 221 and then is stored in the condensed water collector 230. In some examples, a bottom face of the cover seated groove 220 can be formed inclined toward a portion where the condensed water collector 230 is located, so that the condensed water flowing down to the floor in the cover seated groove 220 is smoothly transferred to the condensed water collector 230 along the inclined bottom face.

In addition, residual water stored in the condensed water collector 230 can be drained into the water discharge container 160 after all operations have been terminated.

In some examples, a controller 170 can be installed inside the cabinet 100.

The controller 170 can be configured to control the operation of the laundry treatment apparatus. For example, the controller 170 can include one or more processors, an electric circuit, or a circuit board.

The controller 170 can be configured to control the operation of the laundry treatment apparatus based on a user's manipulation applied through an input interface 140 of the cabinet 100.

In some implementations, the controller 170 can be programmed to control operations of the circulation fan assembly 500 and the compressor 410 to performs a drying operation on the treatment target, and to control an operation of the discharge pump 310 based on a water-level identified by a water-level sensor 326 to be described later to perform a water discharging operation in which the residual water stored in the condensed water collector 230 is pumped and drained out. In some examples, the water-level sensor 326 is installed in the discharge pump assembly 300 and configured to detect the condensed water-level in the condensed water collector 230.

The drum 110 is described with referring to FIG. 1 and FIG. 3.

In some implementations, the drum 110 can include a cylindrical body with front and rear openings. The front opening of the drum 110 can communicate with the drying target inlet 101 of the cabinet 100. In some examples, the drum can rotate while being supported on a roller 111 in the cabinet 100.

The drum 110 can be configured such that hot dry hot-air can flow into the drum. In some examples, the drying hot-air can be introduced into an inner space of the drum through the rear opening of the drum 110 and then discharged to the outside of the drum 110 through the front opening of the drum 110.

Further, the front opening and the rear opening of the drum 110 can be connected to the circulation channel 210 which extends through the condenser 420 and the evaporator 440 of the heat pump system to be described later.

That is, the drying target in the drum 110 can be dried with high-temperature dry air supplied from the heat pump system through the circulation channel 210. The humid air that contains moisture as the drying target is dried is supplied to the heat pump system. In some examples, this circulation can be repeated, as shown in FIG. 2.

In some examples, a dryness sensor 112 (refer to FIG. 2) can be further disposed inside the drum 110.

The dryness sensor 112 can be configured to identify dryness of the drying target, and can be composed of two electrodes. In some examples, the two electrodes can be exposed toward the inside of the drum 110 while being spaced apart from each other. The dryness sensor 112 can be installed on the door 120, for example, or can be installed on the cabinet 100 adjacent to the door.

The dryness sensor (e.g., the two electrodes) 112 can determine the dryness of the drying target based on an electrode value. In some examples, a current value varies according to the drying target's condition, for example, a wetness of the drying target when the drying target comes into contact with the electrodes. Then, the current value is converted into the electrode value. For example, when considering that the drying target acts as a resistance to the two electrodes of the dryness sensor 112, the current flowing through a circuit varies because the resistance value varies according to a moisture content of the drying target. A fluctuation value of the variable current is converted into a predetermined electrode value. Thus, the dryness can be determined based on the electrode value.

In some examples, the predefined electrode value can be an arbitrary value converted into a numerical range in which the laundry treatment apparatus is easily controlled.

Next, the discharge pump assembly 300 is illustrated with reference to FIGS. 7 to 13.

Figure 8:
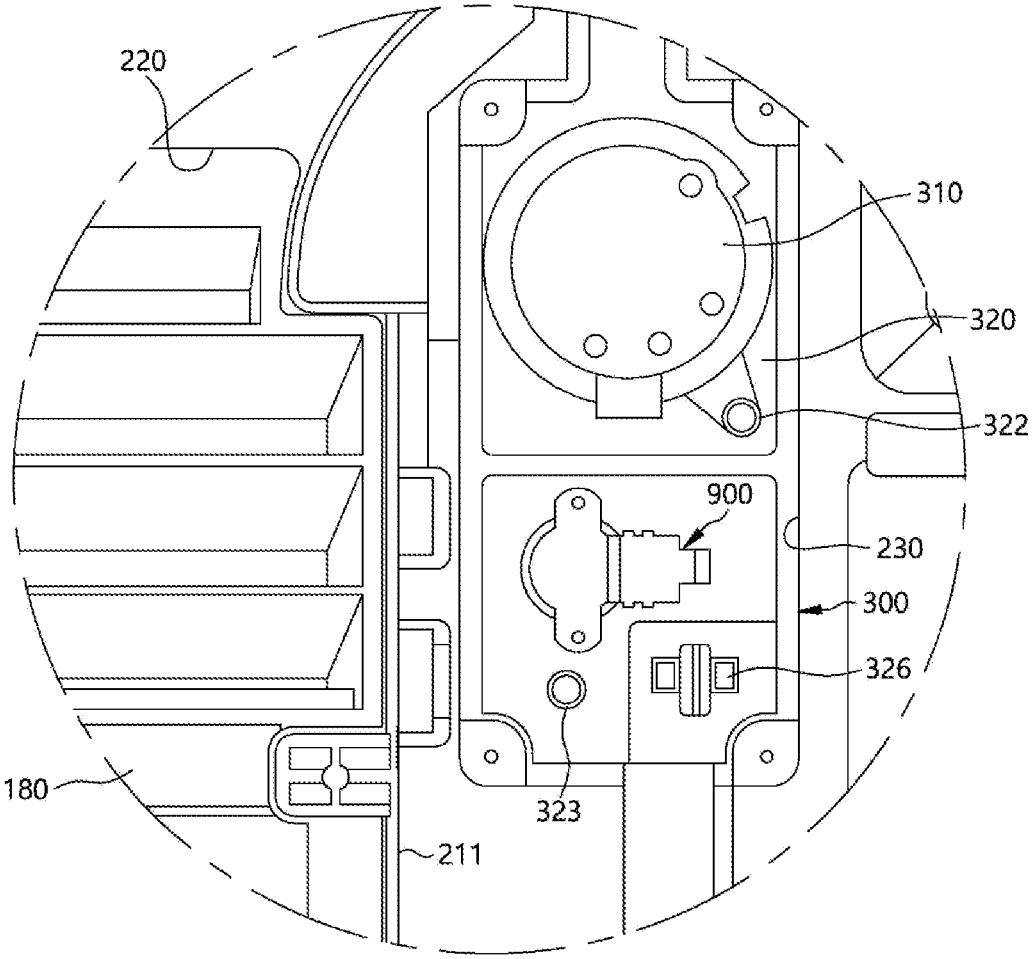
FIG. 8 is an enlarged view of a portion "B" of FIG. 7.
Figure 9:
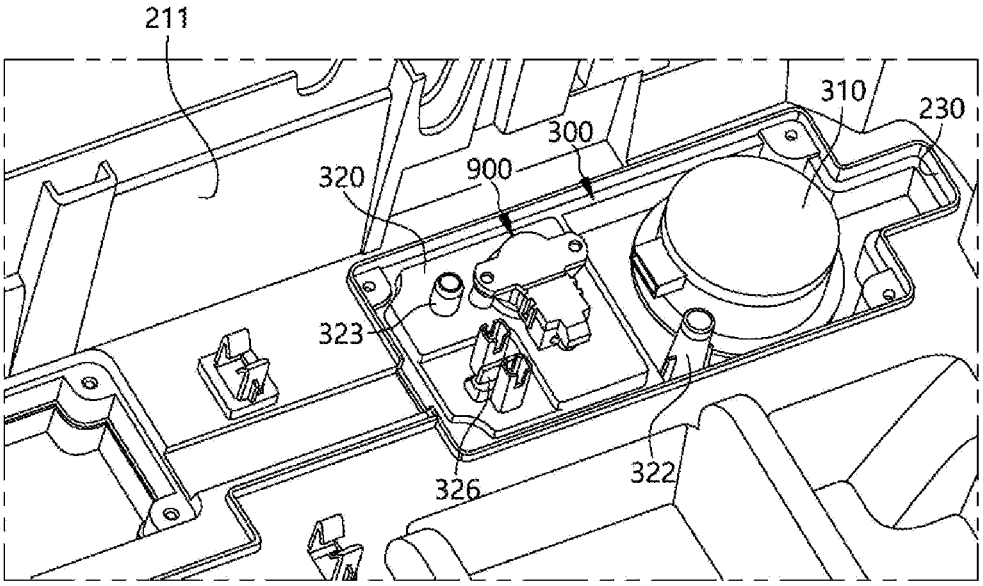
FIG. 9 is a perspective view showing main components of a laundry treatment apparatus for illustrating a state where a discharge pump assembly is installed in a condensed water collector.
Figure 10:
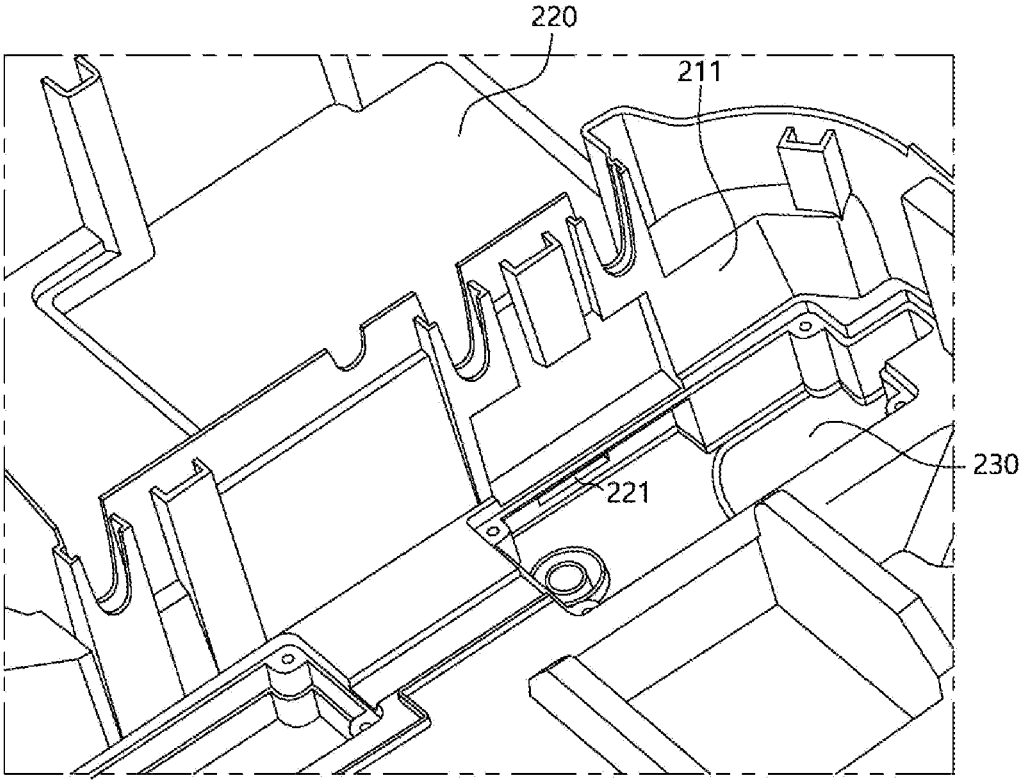
FIG. 10 is a perspective view showing example components of the laundry treatment apparatus in a state in which a discharge pump assembly is removed from a condensed water collector.
Figure 11:
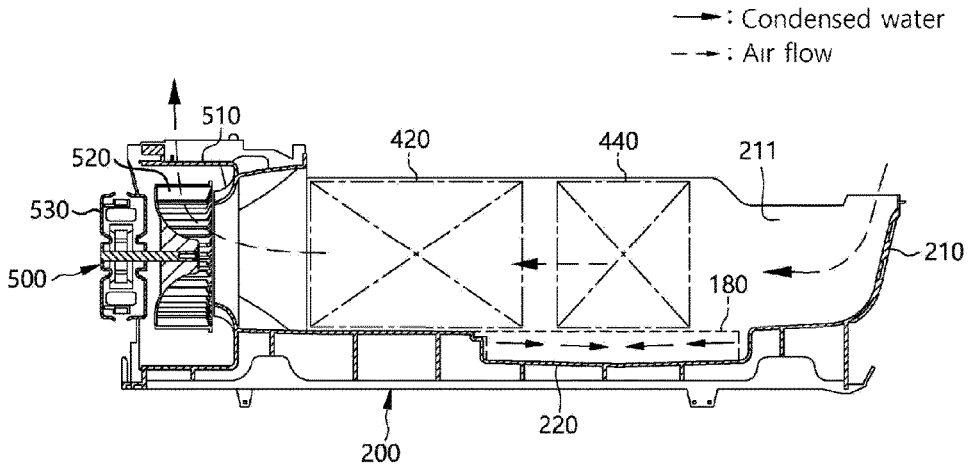
FIG. 11 is a cross-sectional view of I-I line in FIG. 4.
Figure 12:
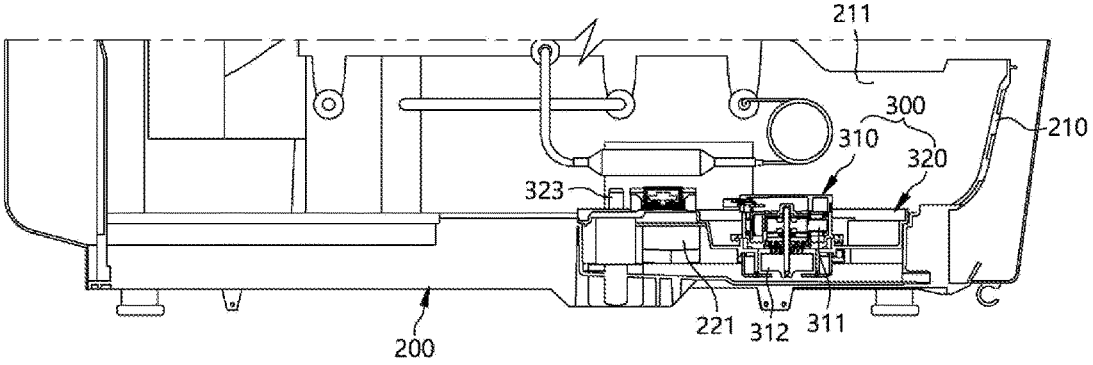
FIG. 12 is a cross-sectional view showing an example of an internal structure including a circulation channel of the laundry treatment apparatus.

The discharge pump assembly 300 is configured to pump the condensed water stored in the condensed water collector 230. As shown in FIGS. 7 to 9, the discharge pump assembly 300 can be accommodated and mounted in the condensed water collector 230.

The discharge pump assembly 300 can include a discharge pump 310 and a pump cover 320.

In some examples, the discharge pump 310 is configured to pump the condensed water stored in the condensed water collector 230.

The discharge pump 310 can be configured to pump the condensed water stored in the condensed water collector 230 via rotation of an impeller thereof when a discharge motor thereof is activated.

In some examples, the pump cover 320 can be configured such that the inside of the condensed water collector 230 in which the discharge pump 310 is installed acts as a pumping space blocked from an external environment.

The pump cover 320 can be implemented as a casing with an open bottom that covers and closes an open top face of the condensed water collector 230.

That is, the pump cover 320 can allow the inside of the condensed water collector 230 to act as a closed space from the outside. Accordingly, a pumping operation of the discharge pump 310 can be stably performed.

Figure 13:
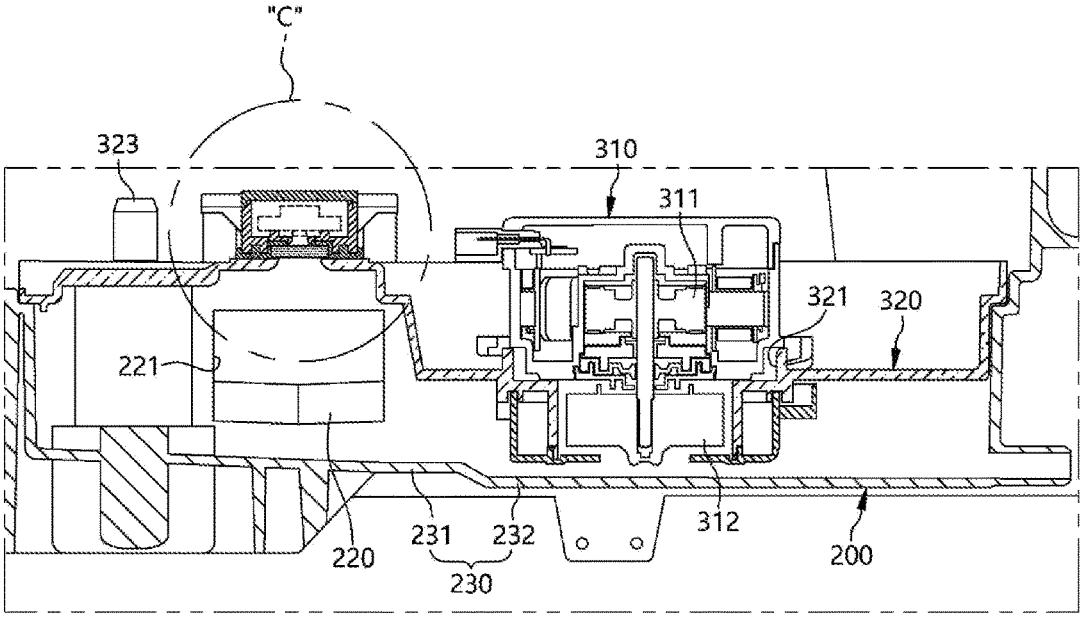
FIG. 13 is an enlarged cross-sectional view showing an example portion where the discharge pump assembly is installed in FIG. 12.

In some examples, the pump cover 320 can have an installation hole 321 extending therethrough. The discharge pump 310 can include an impeller 312 located inside the condensed water collector 230 relative to the installation hole 321 of the pump cover 320, and a discharge motor 311 installed outside the condensed water collector 230 relative to the installation hole 321 of the pump cover 320, as shown in FIG. 13.

In some implementations, an ejection port 322 that guides ejection flow of the condensed water pumped by the operation of the discharge pump 310 is formed to protrude upward from the pump cover 320. A pumping guide hose is connected to the ejection port 322, such that the condensed water pumped by the discharge pump 310 is guided by the pumping guide hose and then passes through a flow guide valve 640 (see FIG. 6) and is stored in the water discharge container 160.

Further, the water-level sensor 326 can be installed on the pump cover 320. In some examples, the water-level sensor 326 senses the water-level in the condensed water collector 230 and provides the same to the controller 170. The discharge pump 310 can be controlled to operate based on the water-level in the condensed water collector 230 sensed by the water-level sensor 326.

In some implementations, a collection port 323 for collection flow of the condensed water overflowing from the water discharge container 160 can be further formed on the pump cover 320. For instance, the collection port 323 can be a pipe.

The collection port 323 can be configured to communicate with the through-hole (the condensed water inlet side) of the condensed water collector 230. Thus, the condensed water collected from the water discharge container 160 through the corresponding collection port 323 and the condensed water flowing down the cover seated groove 220 of the base frame 200 and flowing into the condensed water collector 230 can meet each other at the same location, and then can inflow toward the discharge pump 310. In some examples, the collection port 323 can be connected to the water discharge container 160 via a collection channel.

Next, the heat pump system is illustrated with reference to FIG. 2.

The heat pump system is configured to produce high temperature dry air via heat exchange of the humid air discharged from the drum 110.

That is, the air to be supplied into the drum 110 can always have a high temperature and dry state due to the heat pump system.

In some implementations, the heat pump system can include the compressor 410, the condenser 420, an expander 430, and an evaporator 440.

The compressor 410 can be a device that receives high-temperature, and low-pressure refrigerant for heat exchange and compresses the refrigerant into high-temperature, and high-pressure refrigerant. The condenser 420 is a device that receives the high temperature and high pressure refrigerant and condenses the refrigerant into low temperature and high pressure refrigerant. The expander 430 is a device that receives the condensed low temperature and high pressure refrigerant and expands the refrigerant into low temperature low pressure refrigerant. The evaporator 440 is a device that receives the low-temperature and low-pressure refrigerant and heat-exchanges between the refrigerants and surrounding air. In some examples, the refrigerant passing through the evaporator 440 is in a high temperature and low pressure state. The high temperature and low pressure refrigerant can be fed to the compressor 410. This process can be repeated.

In the laundry treatment apparatus, the compressor 410 and the expander 430 are located on one side of the top face of the base frame 200 (see FIG. 4). The condenser 420 and evaporator 440 can be positioned within the circulation channel 210 (see FIGS. 6 and 7 and 10).

In some implementations, the evaporator 440 can be disposed on a humid air inflow side of the circulation channel 210, and performs a function of removing moisture therefrom by heat-exchanging the air with the low-temperature and low-pressure refrigerant. The condenser 420 is disposed on an air outflow side of the evaporator 440 and increase a temperature of dry air whose temperature is lowered while passing through the evaporator 440.

In some implementations, when considering that the compressor 410 generates a large amount of heat during its operation, the compressor 410 can be disposed adjacent to a heat-dissipation fan 411 for heat dissipation from the compressor 410. That is, the heat-dissipation fan 411 can perform the heat dissipation from the compressor 410.

The compressor 410 and the expander 430 can be spaced from the circulation channel 210 so as not to affect the circulating air (air flow and temperature thereof).

Next, with reference to FIG. 4 and FIG. 6, the circulation fan assembly 500 will be described.

The circulation fan assembly 500 is configured to forcibly circulate air.

That is, air that has sequentially passed through the evaporator 440 and the condenser 420 in the circulation channel 210 under activation of the circulation fan assembly 500 can be supplied into the drum 110 through the inlet duct 212. Then, the air passing through the drum 110 can sequentially pass through the evaporator 440 and the condenser 420 in the circulation channel 210 through the outlet duct 213. This air circulation can be repeated.

The circulation fan assembly 500 can be located on the air outflow side of the condenser 420 of the circulation channel 210.

In particular, the circulation fan assembly 500 can include a circulation fan 520 installed to be accommodated in a fan housing 510 and a fan motor 530 that drives the circulation fan 520. In some examples, an air inlet of the fan housing 510 can be connected to the circulation channel 210, and an air outlet of the fan housing 510 can be connected to the inlet duct 212.

The sterilization module 900 is illustrated with reference to FIGS. 14 to 18.

Figure 14:
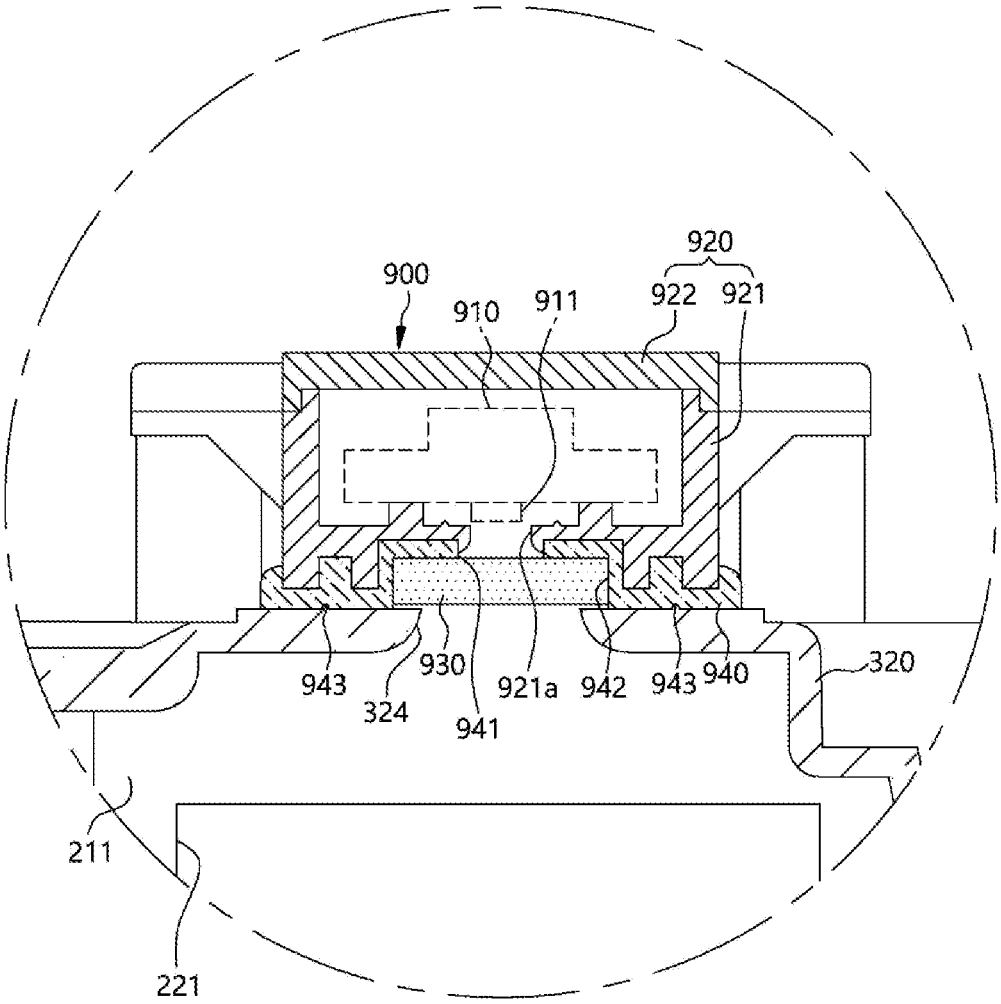
FIG. 14 is an enlarged view of a portion "C" in FIG. 13.
Figure 15:
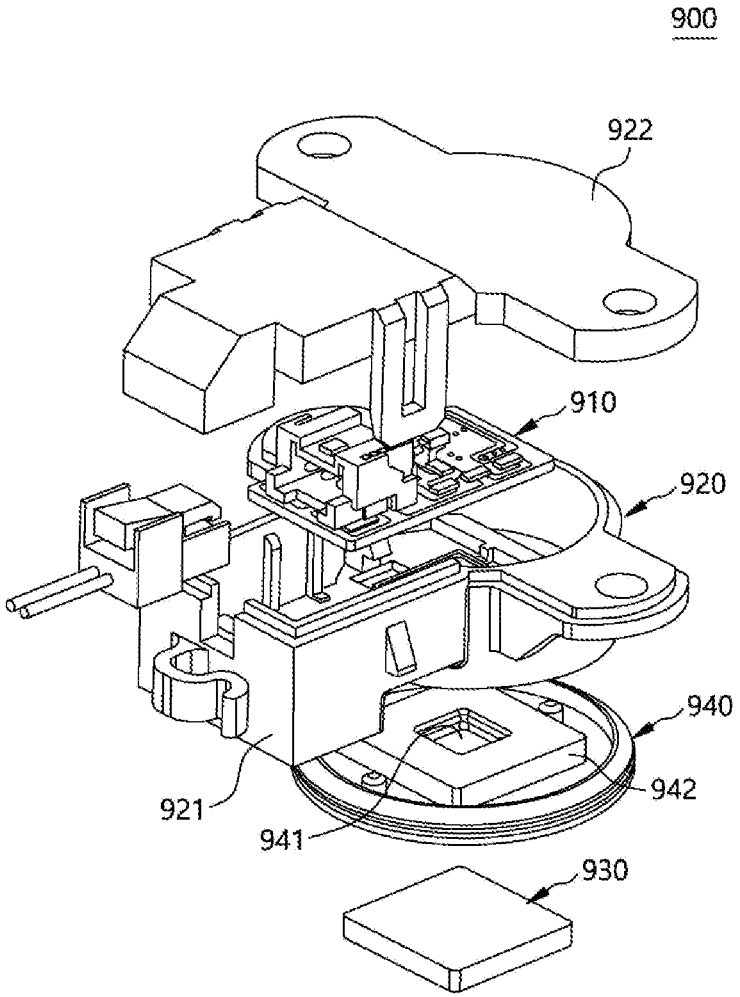
FIG. 15 is an exploded perspective view showing an example of a sterilization module of the laundry treatment apparatus.
Figure 16:
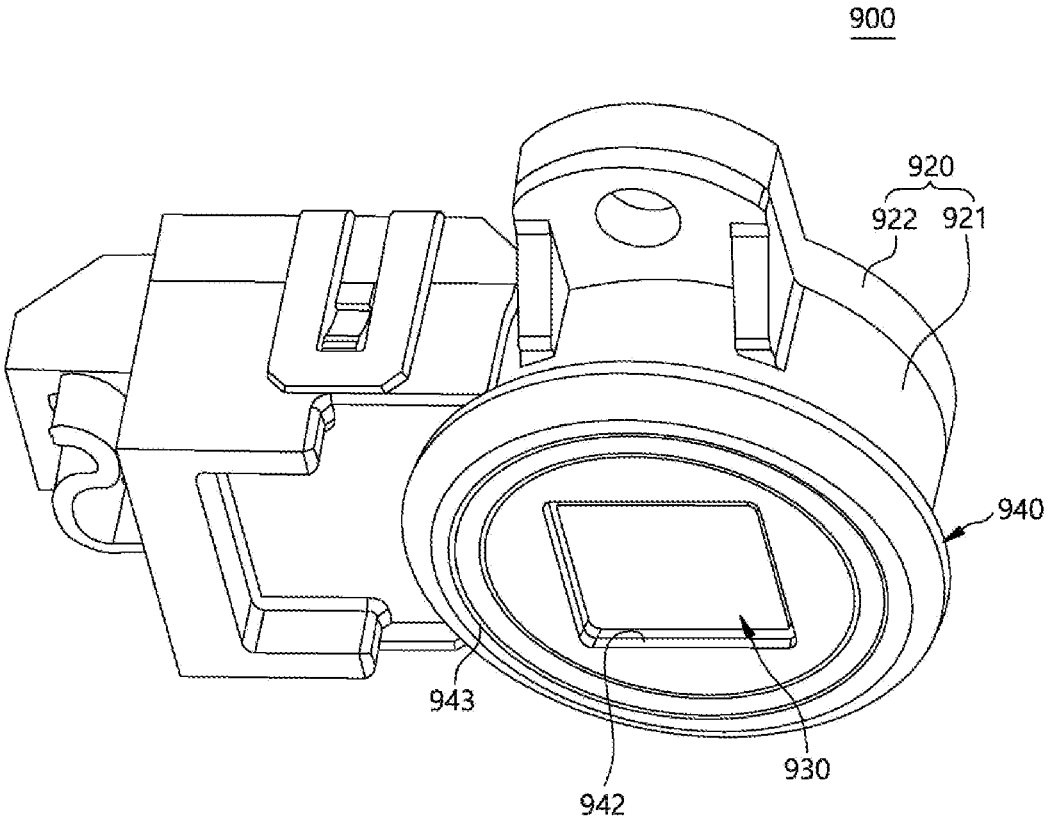
FIG. 16 is a bottom perspective view illustrating the sterilization module of the laundry treatment apparatus.
Figure 17:
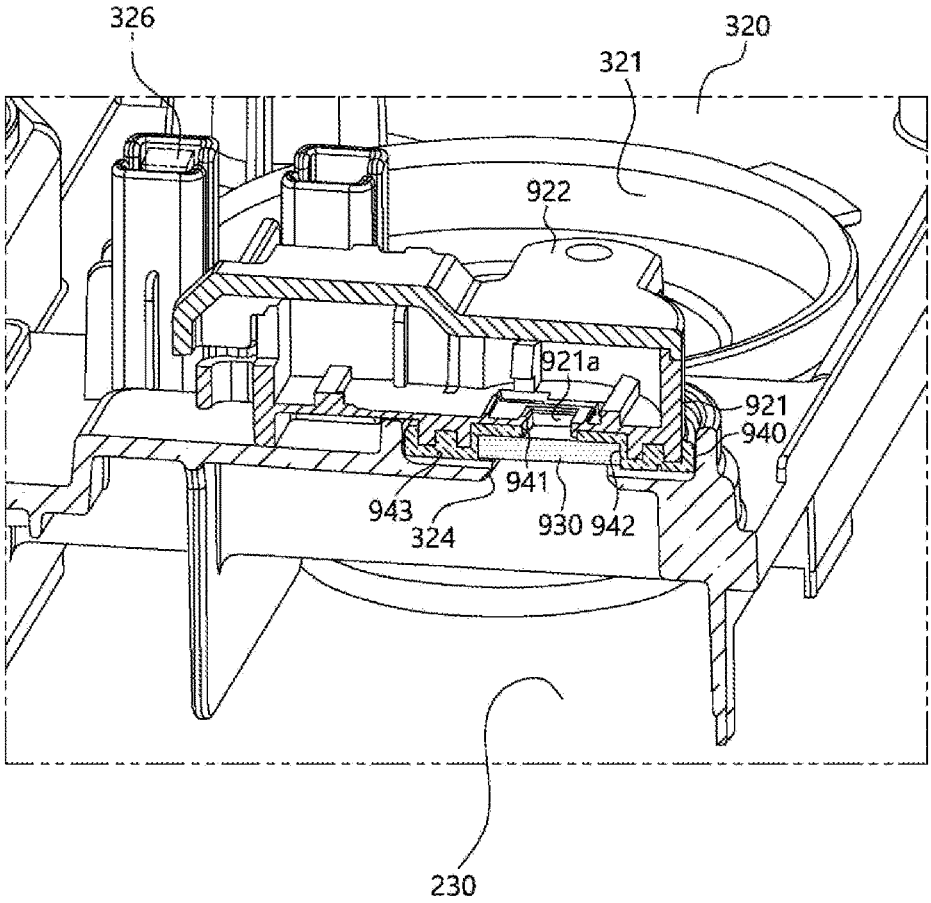
FIG. 17 is a cross-sectional perspective view illustrating an installation state of the sterilization module of the laundry treatment apparatus.
Figure 18:
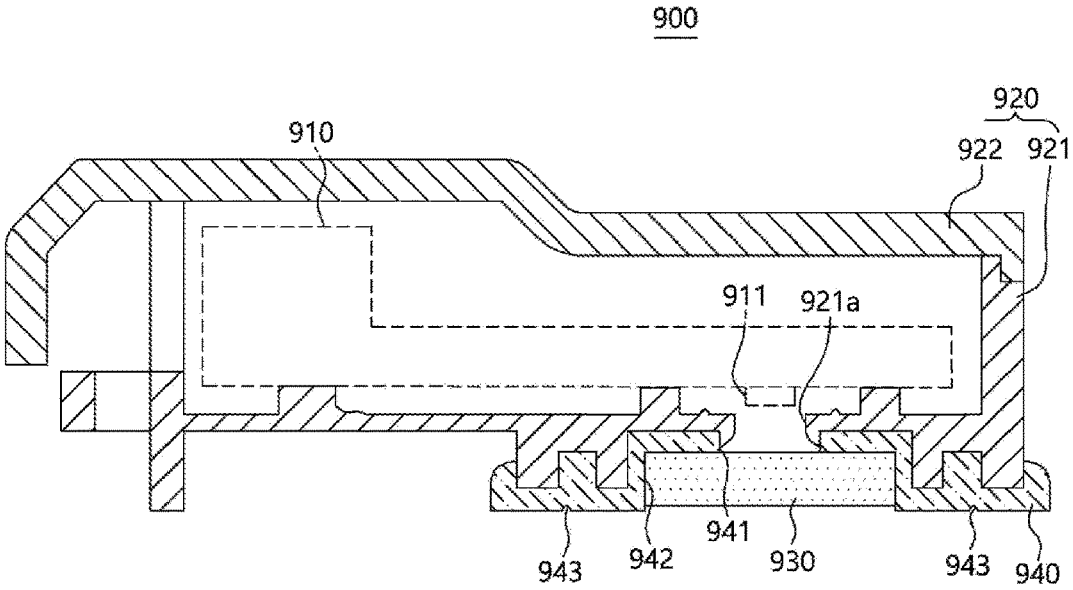
FIG. 18 is a cross-sectional view showing the sterilization module of the laundry treatment apparatus.
Figure 19:
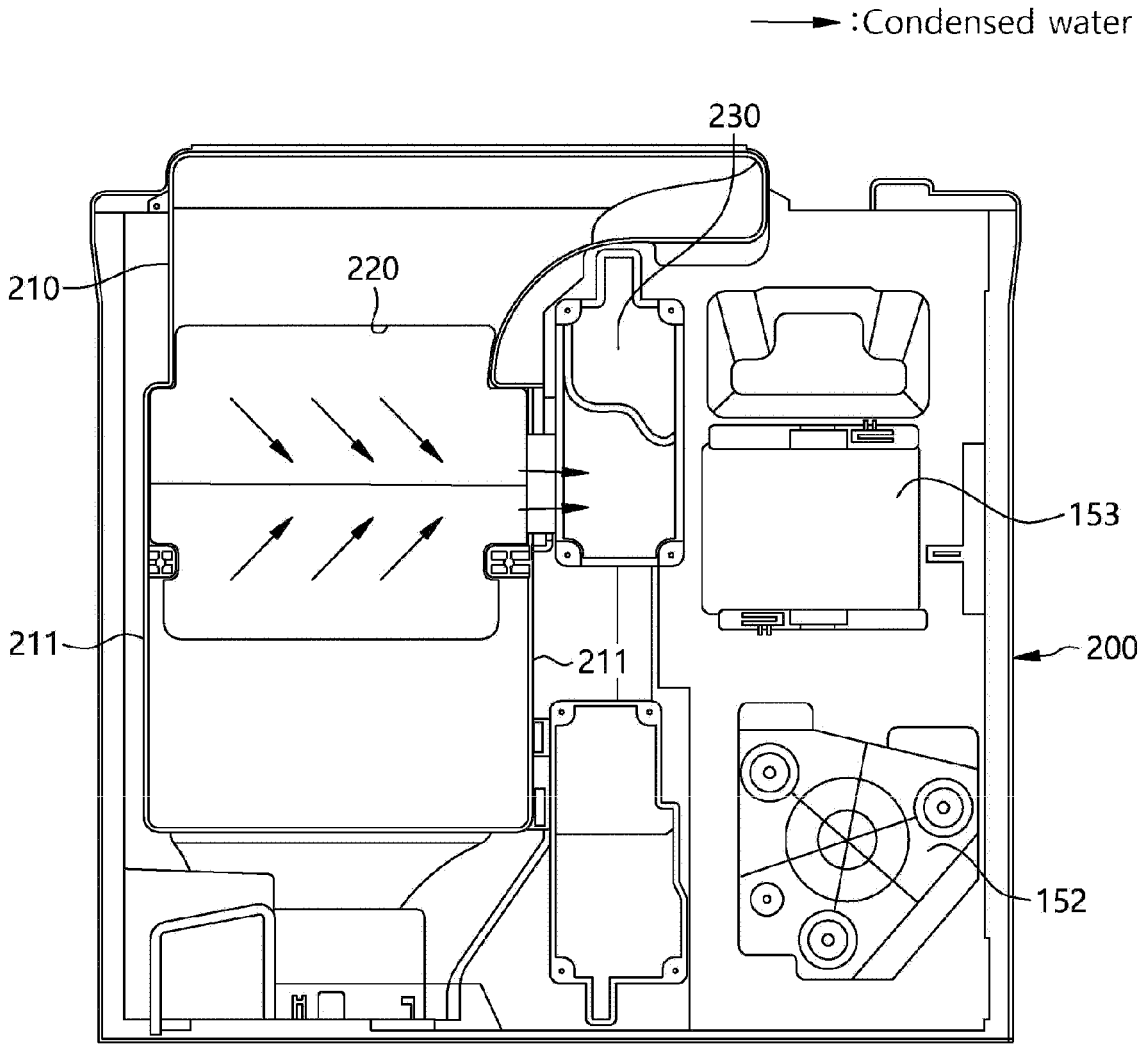
FIG. 19 is a plan view showing an example of condensed water flowing to the condensed water collector during a drying operation of the laundry treatment apparatus.
Figure 20:
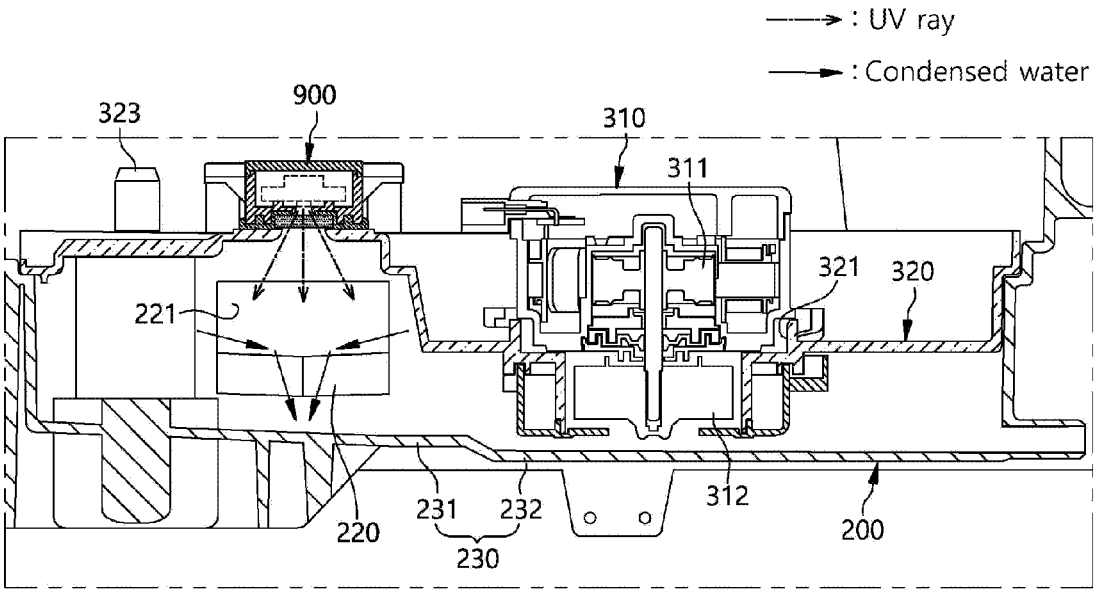
FIG. 20 is a cross-sectional view showing an example in which the condensed water flows to the condensed water collector and an operation state of the sterilization module during the drying operation of the laundry treatment apparatus.

FIG. 14 is an enlarged view showing an example of an installation state of the discharge pump assembly and the sterilization module. FIG. 15 is an exploded perspective view showing an example structure of a sterilization module of the laundry treatment apparatus. FIG. 16 is a bottom perspective view to illustrate an example structure of the sterilization module of the laundry treatment apparatus. FIG. 17 is a cross-sectional perspective view of a state in which some components are partially cut away to illustrate an installation state of the sterilization module of the laundry treatment apparatus. FIG. 18 is a cross-sectional view showing an example structure of the sterilization module of the laundry treatment apparatus.

The sterilization module 900 is configured to sterilize the condensed water in the condensed water collector 230.

The sterilization module 900 can be installed on the pump cover 320 constituting the discharge pump assembly 300.

The pump cover 320 can have a light-transmitting hole 324 passing through the pump cover 320. The sterilization module 900 can be configured to irradiate the sterilization light into the condensed water collector 230 through the light-transmitting hole 324.

In some examples, the light-transmitting hole 324 can pass through the top face of the pump cover 320. The sterilization module 900 can be installed on an outer face of the top of the pump cover 320 and at a location where the light-transmitting hole 324 is located. The position of the light-transmitting hole 324 and the installation position of the sterilization module 900 can be selected such that the pump cover 320 can be easily combined with or separated from the sterilization module 900, thereby to facilitate maintenance thereof.

In some implementations, the light-transmitting hole 324 can be located at a portion of a top of the pump cover 320 where condensed water flows into the condensed water collector 230. In some examples, the sterilization light irradiated from the sterilization module 900 can be irritated to the condensed water while the condensed water is flowing into the condensed water collector 230.

In some implementations, the light-transmitting hole 324 can be formed in a portion of the condensed water collector 230 where the condensed water remains. However, while an area where the condensed water remains as described above is substantially wide, the sterilization light irradiated from the sterilization module 900 has an irradiating angle sized such that the light can be irradiated only toward a portion of the condensed water. When the light-transmitting hole 324 can be formed in a portion of the condensed water collector 230 where the condensed water remains, the sterilization effect can be degraded.

In some examples, the sterilization light can be irradiated toward a portion where the condensed water is flowing into the condensed water collector 230 as in the above-described implementations.

In some examples, the sterilization light irradiated from the sterilization module 900 is short-wavelength ultraviolet-ray or ultraviolet light with excellent sterilization ability. For example, providing the short-wavelength ultraviolet-ray (UV-C) having a wavelength of 100 to 280 nm as a sterilization light can achieve excellent sterilization power. In some examples, the ultraviolet light may have one or more wavelengths in the range of 100 to 280 nm.

In some implementations, the sterilization module 900 includes the circuit board 910 on which a short-wavelength ultraviolet-ray irradiation LED (Light Emitting Diode) (hereinafter referred to as "irradiation LED") 911 is mounted. In addition, the sterilization module 900 can include a casing 920 for stable installation of the circuit board 910 and protection from the external environment, a transmissive window 930 and a sealing member 940.

The components of the sterilization module 900 are described in more detail as follows.

The casing 920 is configured to provide an installation space for the circuit board 910.

The casing 920 can include a casing body 921 with a closed bottom face and an open top face, and a top face cover 922 covering the open top face of the casing body 921. In some examples, the circuit board 910 can be installed inside the casing body 921. For example, the casing body 921 is configured such that an inner space thereof is open so that the circuit board 910 located therein can be subject to maintenance.

In some examples, the casing 920 can be fastened to the top face of the pump cover 320 with screws or bolts, which may make it easy to separate or combine the sterilization module 900 from the pump cover 320.

In addition, an irradiation hole 921*a* communicating with the light-transmitting hole 324 of the pump cover 320 can be defined in a bottom face of the casing body 921 that constitutes the casing 920. The irradiation LED 911 of the circuit board 910 can be installed to irradiate the short-wavelength ultraviolet-ray through the irradiation hole 921*a*.

In addition, the short-wavelength ultraviolet-ray irradiated from the irradiation LED 911 can transmit through the transmissive window 930. For example, the transmissive window 930 can be made of quartz.

In addition, the sealing member 940 can prevent the condensed water in the condensed water collector 230 from invading the circuit board 910 and can allow the transmissive window 930 to be coupled to the casing 920.

The sealing member 940 can be made of a silicon material, so that the sealing member can maintain airtightness while being in close contact with the pump cover 320. This is to prevent or reduce the condensed water from inflowing through the light-transmitting hole 324.

Further, the sealing member 940 can have a circular ring structure in which a communication-hole 941 is formed in an inner central portion. In some implementations, the sealing member 940 can be formed in a square frame structure having the communication-hole 941 in a center region thereof. However, in order to increase a contact area to increase the airtightness, it would be more desirable to form the sealing member 940 in the circular ring structure.

In some examples, the communication-hole 941 is formed in the central portion of the sealing member 940 and communicate the irradiation hole 921*a* of the casing 920 and the light-transmitting hole 324 of the pump cover 320 with each other. The transmissive window 930 can be installed to cover the communication-hole 941.

In particular, a recess 942 is formed in a bottom face of the sealing member 940 and around the communication-hole 941. The transmissive window 930 can be fixedly inserted in the recess 942.

In some examples, a recess depth of the recess 942 can be larger than a thickness of the transmissive window 930. As a result, when the sealing member 940 comes into contact with a surface of the pump cover 320, the sealing member can be compressed and deformed so that the sealing member can be adhered thereto as closely as possible.

In some implementations, at least one circular concave-convex pattern 943 can be further formed in the bottom face of the sealing member 940 and between a circumference of the sealing member 940 and a portion thereof where the recess 942 is formed. In some examples, the circular concave-convex pattern 943 can be implemented as a groove recessed from the surface of the sealing member 940. The circular concave-convex pattern 943 can prevent the moisture existing outside the sealing member 940 from invading the transmissive window 930 in the recess 942 as much as possible. In some examples, the circular concave-convex pattern 943 can be implemented as a protrusion protruding from the surface of the sealing member 940.

In some examples, the laundry treatment apparatus can include a cleaner 600 (see FIG. 2) for cleaning of a surface of the evaporator 440.

Hereinafter, the drying operation and the sterilization operation of the laundry treatment apparatus described above will be described in more detail.

In some examples, control of each of the components or the sensor and the valve related to each operation is performed by the controller 170 based on information as pre-programmed or in a set sequence. Hereinafter, although the description that the control of each of the components or the sensor and the valve related to each operation is performed by the controller 170 is absent, the control of each of the components or the sensor and the valve related to each operation is performed by the controller 170.

The drying operation can be configured for drying the drying target.

For example, the drying operation can be performed via user manipulation. That is, when the drying operation is selected via the user's manipulation, the controller 170 can control the operations of the heat pump system and the circulation fan assembly 500 to perform the drying operation.

In some examples, the flow of the refrigerant circulating through the heat pump system under the operation of the compressor 410 and the circulating flow of air passing through the evaporator 440 and the condenser 420 sequentially under the operation of the circulation fan assembly 500 can allow the moisture contained in the air to be removed, and then allow the dry air in a high temperature state to be supplied into the drum 110 to dry the drying target.

For example, the humid air discharged from the drum 110 flows into the circulation channel 210 through the outlet duct 213, and then passes through the evaporator 440 located in the circulation channel 210 such that the moisture is removed therefrom and then passes through the condenser 420 such that the dry air is heated. Then, the air passes through the fan housing 510 of the circulation fan assembly 500 and flows to the inlet duct 212, and then is supplied into the drum 110. This circulation process can be repeated.

Further, while the humid air passes through the evaporator 440 during the above-described air circulation process, the moisture contained in the air can condense on the surface (a surface of each heat exchange fin) of the evaporator 440 and can flow down along the surface and can drop onto the water cover 180 and then can be collected in the cover seated groove 220.

Then, the condensed water collected in the cover seated groove 220 can flow to a rear portion of the cover seated groove 220 along a slope of the bottom face of the cover seated groove 220 and can be stored in the condensed water collector 230 through the through-hole 221.

In particular, when the above drying operation is performed, the sterilization module 900 is powered on such that the irradiation LED 911 emits light. Thus, the short-wavelength ultraviolet-ray therefrom can be irradiated toward the condensed water flowing into the condensed water collector 230 through the through-hole 221.

For example, the short-wavelength ultraviolet-ray can sequentially pass through the irradiation hole 921*a* of the casing 920 constituting the sterilization module 900, the transmissive window 930, and the light-transmitting hole 324 of the pump cover 320, and can be irradiated toward the condensed water flowing into the condensed water collector 230 through the through-hole 221.

Thus, the condensed water flowing into the condensed water collector 230 can be sterilized by the short-wavelength ultraviolet-ray and then can be stored in the condensed water collector 230.

In some examples, when the condensed water flows into the condensed water collector 230, the water-level sensor 326 disposed in the condensed water collector 230 detects the water-level of the condensed water stored in the condensed water collector 230. Then, based on the detected water-level, the controller 170 can determine whether to drain the residual water in the condensed water collector 230 to the water discharge container 160.

When the controller 170 determines to drain the residual water in the condensed water collector 230 to the water discharge container 160, the condensed water in the condensed water collector 230 can be pumped and stored to the water discharge container 160 under the operations of the discharge pump 310 and the flow guide valve 640.

Further, when an amount of the condensed water pumped and stored into the water discharge container 160 exceeds an allowable storage amount of the water discharge container 160, the condensed water can overflow from the water discharge container 160, and then the condensed water overflowing from the water discharge container 160 can pass through the collection port 323 of the pump cover 320 along a collection channel and then be collected into the condensed water collector 230.

The condensed water collected in this process can join the condensed water that flows into the condensed water collector 230 through the through-hole 221, or the condensed water collected in the process alone can flow into a condensed water inflow side of the condensed water collector 230. Subsequently, the condensed water can be sterilized under the influence of the short-wavelength ultraviolet-ray irradiated from the sterilization module 900 to the condensed water inlet side of the condensed water collector 230 and can be stored in the condensed water collector 230.

Eventually, as the irradiation LED 911 of the above-described sterilization module 900 continuously irradiates the short-wavelength ultraviolet-ray to the condensed water flowing into the condensed water collector 230, the contamination of the condensed water stored in the condensed water collector 230 can be prevented or delayed as much as possible.

In some examples, the sterilization module 900 is not limited to irradiating the short-wavelength ultraviolet-rays only during the drying operation.

For example, when considering that as the short-wavelength ultraviolet-ray is irradiated from the sterilization module 900 for a longer time, better sterilization power can be acquired, the sterilization module 900 can be controlled to continuously irradiate the short-wavelength ultraviolet-rays before or after the drying operation is performed.

In particular, at the end of the drying operation when the heat pump system and the circulation fan assembly 500 are deactivated, the discharge pump assembly 300 and the sterilization module 900 can be activated to further perform the sterilization operation for sterilizing the condensed water for a certain period of time.

For example, when considering the irradiating angle of the short-wavelength ultraviolet-ray irradiated from the sterilization module 900, the sterilization module 900 may not evenly irradiate the short-wavelength ultraviolet-ray to an entire region of the condensed water collector 230. Thus, there is a concern that bacteria present in the condensed water in an area to which the short-wavelength ultraviolet-ray is not irradiated can breed. Thus, it would be desirable to further increase the sterilization power for the condensed water by allowing the condensed water in the condensed water collector 230 to be continuously mixed with each other during the operation of the sterilization module 900.

In some implementations, when the condensed water stored in the condensed water collector 230 has a water-level at which the condensed water can be completely pumped under the operation of the discharge pump 310, the condensed water can be pumped and discharged under the operation of the discharge pump 310, and can flow into the condensed water collector 230. Thus, the condensed water can be sterilized during the circulation. Further, when the condensed water stored in the condensed water collector 230 has a water-level at which the condensed water may not be completely pumped under the operation of the discharge pump 310, the condensed water can flow in the condensed water collector due to a wind resulting from a rotational motion of the impeller of the discharge pump 310. Thus, the condensed water present in a blind spot of the condensed water collector 230 to which the short-wavelength ultraviolet-ray is not irradiated can flow to a region to which the short-wavelength ultraviolet-ray is irradiated and thus can be sufficiently subject to the short-wavelength ultraviolet-ray.

When pumping the condensed water in the condensed water collector 230 under the operation of the discharge pump assembly 300, the flow guide valve 640 can be controlled.

That is, under the control of the flow guide valve 640, the condensed water is not pumped to the water discharge container 160 but flows through the cleaner 600 to the cover seated groove 220 and then flows along the cover seated groove 220 and is collected again into the condensed water collector 230. Alternatively, under the control of the flow guide valve 640, the condensed water is pumped to the water discharge container 160 and is collected into the condensed water collector 230 through the collection channel and the collection port 323.

Further, during the operation of the sterilization operation as described above, the discharge pump assembly 300 can be controlled such that the discharge pump assembly 300 can be activated and deactivated in a repeated manner.

For example, the repetitive activation and deactivation of the discharge pump 310 can allow the condensed water present in various portions of the condensed water collector 230 not to be kept in a stagnant state, but to flow and to be mixed with each other and be sterilized to improve the sterilization effect.

In some implementations, the discharge pump assembly 300 can be controlled so that the operation time duration thereof is shorter than the operation stop time duration. That is, the pumping operation is performed only for a short period of time so that power consumption can be reduced, while the condensed water in the condensed water collector 230 can be smoothly mixed with each other.

In some examples, when the condensed water remains in the condensed water collector 230, the remaining condensed water can be brought into a sterilized state by the above-described series of processes using the sterilization module 900, so that contamination can be prevented or reduced.

The sterilization operation can be performed only under the operation of the sterilization module 900. For example, after all operations are completed, only the sterilization module 900 is continuously or periodically (for example, for a certain period of time every day or once every few days) activated so that the contamination of the condensed water in the condensed water collector 230 can be continuously prevented.

Thus, the laundry treatment apparatus and the method for operating the apparatus can sterilize the condensed water stored in the condensed water collector 230 via the additional provision of the sterilization module 900, thereby preventing the contamination of the condensed water.

Further, the laundry treatment apparatus and the method for operating the apparatus are configured to sterilize the condensed water in the process of introducing the condensed water into the condensed water collector 230, so that condensed water contamination in the condensed water collector 230 can be prevented or delayed as much as possible.

Further, the laundry treatment apparatus and the method for operating the apparatus can execute the sterilization operation for irradiating the light continuously into the condensed water collector 230 even when the drying operation is terminated, thereby suppressing the bacterial proliferation of the condensed water remaining in the condensed water collector 230.

Further, in the laundry treatment apparatus and the method for operating the apparatus, the sterilization module 900 is interchangeably installed on the outer face of the pump cover 320 for easy assembly and disassembly and thus maintenance thereof.

Further, the laundry treatment apparatus and the method for operating the apparatus are configured so that a portion where the circuit board 910 of the sterilization module 900 is installed can maintain the airtightness from the inner space of the condensed water collector 230, and the airtightness is stably and perfectly maintained, such that the damage to the circuit board 910 due to moisture penetration can be prevented.

Further, the laundry treatment apparatus and the operation control method thereof to which the sterilization module 900 is applied are not limited to being implemented only with the structure of the illustrated implementations.

In some examples, the discharge pump assembly 300 can be disposed on the rear side of the base frame 200, and the sterilization module 900 can be installed at a location of the discharge pump assembly 300 to which the condensed water is collected. In some implementations, the sterilization operation using the sterilization module 900 can also be performed in the same manner as the operation of the above-described implementations.

The laundry treatment apparatus and the operation control method thereof to which the sterilization module 900 is applied can be implemented in various forms not shown.

What is claimed is:

1. A laundry treatment apparatus comprising:

a cabinet;

a heat pump configured to heat air for drying laundry and to condense moisture from the air that is used for drying the laundry;

a circulation fan configured to circulate the air;

a condensed water collector that is disposed in the cabinet and defines a collection space configured to receive condensed water therein;

a discharge pump assembly comprising a discharge pump that is disposed at the condensed water collector and configured to pump the condensed water from the condensed water collector;

a water discharge container configured to receive the condensed water pumped from the condensed water collector;

a sterilization module configured to sterilize the condensed water in the condensed water collector by irradiating ultraviolet light; and a controller configured to control the heat pump, the circulation fan, the discharge pump assembly, and the sterilization module, wherein the controller is configured to:

operate the discharge pump to circulate the condensed water in the condensed water collector, and control the sterilization module to irradiate the ultraviolet light to the condensed water circulated by operating the discharge pump.

2. The apparatus of claim 1, wherein the discharge pump assembly further comprises a pump cover that covers the condensed water collector, and wherein the sterilization module is disposed at the pump cover.

3. The apparatus of claim 2, wherein the pump cover defines a light-transmitting hole through the pump cover, and wherein the sterilization module is configured to provide light to the condensed water in the condensed water collector through the light-transmitting hole.

4. The apparatus of claim 3, wherein the light-transmitting hole passes through a top surface of the pump cover, and wherein the sterilization module is disposed on an outer side of the top surface of the pump cover.

5. The apparatus of claim 4, wherein the light-transmitting hole is defined at a position of the top surface of the pump cover to thereby face the condensed water flowing into the condensed water collector.

6. The apparatus of claim 4, wherein the sterilization module comprises a circuit board and a light emitting diode (LED) mounted on the circuit board, the LED being configured to emit ultraviolet light.

7. The apparatus of claim 6, wherein the sterilization module further comprises:

a casing that defines an installation space accommodating the circuit board, and an irradiation hole at a bottom surface of the casing, the irradiation hole being in communication with the light-transmitting hole;

a transmissive window that is disposed at the bottom surface of the casing and covers the irradiation hole; and a sealing that couples the transmissive window to the casing.

8. The apparatus of claim 7, wherein a bottom surface of the sealing covers a portion of the top surface of the pump cover and surrounds the light-transmitting hole, the sealing being configured to block introduction of the condensed water through the light-transmitting hole.

9. The apparatus of claim 8, wherein the bottom surface of the sealing defines a communication-hole that is in communication with the irradiation hole and the light-transmitting hole.

10. The apparatus of claim 9, wherein the bottom surface of the sealing defines a recess that surrounds the communication-hole and receives the transmissive window.

11. The apparatus of claim 10, wherein a recess depth of the recess is greater than a thickness of the transmissive window.

12. The apparatus of claim 7, wherein the sealing has a circular ring shape and defines a communication-hole at a center of the sealing.

13. The apparatus of claim 12, wherein a bottom surface of the sealing defines at least one of a circular concave pattern or a circular convex pattern that surrounds the communication-hole.

14. The apparatus of claim 7, wherein the casing is fastened to the top surface of the pump cover by a screw or a bolt.

15. The apparatus of claim 4, further comprising a collection port disposed on the top surface of the pump cover and configured to collect water overflown from the water discharge container, and wherein the light-transmitting hole is located adjacent to the collection port.

16. The apparatus of claim 1, wherein the sterilization module comprises a circuit board and an LED mounted on the circuit board, the LED being configured to emit ultraviolet light.

17. A laundry treatment apparatus comprising:

a heat pump configured to heat air for drying laundry and to condense moisture from the air that is used for drying the laundry;

a circulation fan configured to circulate the air;

a condensed water collector configured to receive condensed water from the heat pump;

a discharge pump configured to pump the condensed water from the condensed water collector;

a sterilization module configured to irradiate ultraviolet light to the condensed water in the condensed water collector; and a controller configured to control the heat pump, the circulation fan, the discharge pump, and the sterilization module, wherein the controller is configured to:

activate the heat pump and the circulation fan, deactivate the heat pump and the circulation fan, operate the discharge pump to circulate the condensed water in the condensed water collector, and control the sterilization module to irradiate the ultraviolet light to the condensed water circulated by operating the discharge pump.

18. The apparatus of claim 17, wherein the controller is configured to activate the sterilization module to irradiate the ultraviolet light before deactivating the heat pump and the circulation fan.

19. The apparatus of claim 17, wherein the controller is configured to alternately activate and deactivate the discharge pump.

20. The apparatus of claim 19, wherein the controller is configured to set an activation duration for operating the discharge pump and a deactivation duration for stopping operation of the discharge pump, and wherein the activation duration is less than the deactivation duration.

* * * * *